US005318796A

United States Patent [19]

Torpey et al.

[11] Patent Number: 5,318,796

[45] Date of Patent: Jun. 7, 1994

[54] METHOD FOR VARIABLY CONTROLLING THE SPEED OF A SLAVE DRIVE ROLLER IN A WEB COATING MACHINE

[75] Inventors: William A. Torpey, Rochester; Raymond A. Ehnot, Brockport, both of N.Y.; Charles F. Puckhaber, Loveland, Colo.

[73] Assignee: Eastman Kodak Company, Rochester, N.Y.

[21] Appl. No.: 834,424

[22] Filed: Feb. 12, 1992

[51] Int. Cl.[5] ..... B65H 23/188

[52] U.S. Cl. ..... 427/8; 118/672; 118/687; 118/33; 118/712; 226/44

[58] Field of Search ..... 427/8; 118/33, 672, 118/712, 687; 226/44; 242/75.51

[56] References Cited

U.S. PATENT DOCUMENTS

| | | | |
|---|---|---|---|
| 3,187,243 | 6/1965 | Long | 318/6 |
| 4,609,336 | 9/1986 | Stevenson et al. | 425/135 |
| 4,881,489 | 11/1989 | Klebl et al. | 118/672 |
| 4,896,808 | 1/1990 | Bolza-Schuenemann et al. | 226/42 |

FOREIGN PATENT DOCUMENTS

| | | |
|---|---|---|
| 0311805 | 4/1989 | European Pat. Off. . |
| 57-13047 | 1/1982 | Japan . |
| 57-42442 | 3/1982 | Japan . |
| WO89/05477 | 6/1989 | PCT Int'l Appl. . |

OTHER PUBLICATIONS

Keidel, et al, "Catenary Control Systems for Modern Paint Lines", in Iron and Steel Engineer, Aug., 1972, pp. 71–78.

Patent Abstracts of Japan, vol. 7, No. 1 (M-183)(1146) Jan. 6, 1983, Abstract of JP-A-57 160 854, Mitsubishi Denki K.K. for "Catenary Controller".

Machine Design Jan. 22, 1970, Cleveland, U.S.; W. Boyce; "Controlling Speed in Multidrive Systems"; pp. 130–134.

Regelungs-Technische Praxis, vol. 19, No. 3, Mar. 1977, Federal Republic of Germany, M. Brombacher, "Automatisierung von Begiessmaschinen mit Prozessrechnern", pp. 71–76.

D. Satas "Web Handling", in *Web Processing And Converting Technology and Equipment*, pp. 394–401. 1984. (no month date).

H. Weiss, "Tension Transducers", in *Control Systems For Web-Fed Machinery*, pp. 78–97, 1983. (no month date).

W. Boice, "Controlling Speed In Multidrive Systems", in *Machine Design*, pp. 130–134, Jan. 1970.

H. Weiss, "Machine Drive Systems", in *Control Systems For Web-Fed Machinery*, pp. 136–143, 1983. (no month date).

*Primary Examiner*—Shrive Beck
*Assistant Examiner*—Katherine A. Bareford
*Attorney, Agent, or Firm*—Foley & Lardner

[57] ABSTRACT

A method and apparatus is provided for controlling the speed of a slave drive roller in a coating machine. Speed of the slave drive roller at a second coater is regulated by an adaptive gain allowing greater tolerances when not at run speed. That is, in addition to normal speed correction, the system accommodates greater web speed fluctuation during threadup, acceleration, and deceleration. This accommodation may be based on the sensed position of the float roller or, alternatively, on the sensed rate of acceleration/deceleration of the master drive roller.

14 Claims, 3 Drawing Sheets

METHOD FOR VARIABLY CONTROLLING THE SPEED OF A SLAVE DRIVE ROLLER IN A WEB COATING MACHINE

BACKGROUND OF THE INVENTION

This invention relates to a method and apparatus for controlling the speed of a slave drive roller conveying a web by adjusting the range of allowable speed variability of the slave drive roller to different operating conditions. More particularly, the invention relates to such a method and apparatus used for conveying a substrate for photographic film or paper and coating it with photosensitive coatings.

In conveying a web through a coating machine, web speed influences how thick a coating will be applied at a coating station. That is, given a constant flow rate of coating fluid at a coating station, the higher the web speed the thinner the coating on the web. Likewise, the lower the web speed, the thicker the coating. Thus, coating thickness is an inverse function of web speed. If coating thickness uniformity is critical, then web speed uniformity at the coating station is also critical.

In conveying and coating a web for photographic applications, coating thickness is indeed critical. Hence, web speed must be closely controlled.

In a typical method of web conveyance, one drive roller is selected as the master drive roller; the speed of any other drive roller is slaved or controlled with reference to the master drive signal. The controlled speed of the slave drive roller nevertheless varies, within a certain tolerance, from the actual speed of the master drive roller to maintain operating tension in that portion of the machine. Thus, the rotational speed of the slave drive roller is increased or decreased depending on how much web material is stored in a float roller controlling the slave drive roller. Such typical control methods and equipment are described in, for example, W. Boice, "Controlling Speed in Multidrive Systems", in *Machine Design* Jan. 22, 1970; D. Satas, "Web Handling" in *Web Processing and Converting Technology and Equipment*, 1984; H. Weiss, "Tension Transducers" pages 78–97 in *Control Systems for Web-Fed Machines*, 1983; and *Machine Drive Systems* pages 136–143.

In considering certain requirements for a proposed new product, it was appreciated that conventional methods of controlling slave drive roller speed had disadvantages. For example, in applications requiring narrow tolerances between the speed of the master roller and speed of the slave roller, this narrow tolerance is disadvantageous during periods of acceleration or deceleration, for example, during startup or shutdown of the web conveyance operations. This is because excessive time is consumed in acceleration and deceleration of the web when the slave roller is controlled with a small tolerance.

Accordingly, it is one object of the invention to provide a method and apparatus for controlling the speed of the slave drive roller within a small tolerance at times when coating operations are being performed, without sacrificing excessive time during times of acceleration up to running speed and deceleration from running speed. In other words, it is an object of the present invention to provide high gain during times when the coating machine is unstable, to avoid slack or tight web conditions; and to provide low gain during times of normal steady run conditions, to minimize speed deviations at any critical secondary follower or slave drive, such as a second coater in a coating machine; and to change automatically. A higher gain indicates that the control system adjusts the speed of the slave drive roller more quickly and/or by a greater amount in response to changes in control inputs.

It is further an object of the invention to provide a method and apparatus wherein gain is a function of acceleration/deceleration rate such that low gain is used at steady run speed, and higher gain is used during acceleration/deceleration (for example, where gain is proportional to acceleration/deceleration rate).

It is further an object of the invention to provide a method and apparatus wherein gain is a function of float roller position (that is, deviation from a predetermined normal position) such that low gain is used at or near the normal position, and higher gain is used when the float roller is displaced from the normal position (for example, gain may be proportional to deviation, or gain may be proportional to the square (or some other power) of deviation).

Additional objects and advantages of the invention will be set forth in part in the description which follows, and in part will be evident from the description, or may be learned by practice of the invention. The objects and advantages of the invention may be obtained by means of the instrumentalities and combinations particularly pointed out in the appended claims.

SUMMARY OF THE INVENTION

In accordance with the purposes of the invention, as embodied and broadly described herein, the method of the invention for controlling the speed of a slave drive roller comprises the steps of conveying a web around a master drive roller, a float roller, and a slave drive roller; performing one or more operations on the web at selected times; providing a reference speed signal indicative of a reference speed SP; driving the master drive roller at speed SP within tolerance T1 at all times; driving the slave drive roller at speed SP within a first slave drive roller speed tolerance T2 at times when the operations are being performed; and, at times when the operations are not being performed, changing the reference speed (SP), changing the tolerance of the speed of the slave drive roller beyond the value of T2 to a second speed tolerance, and driving the slave drive roller at the changed reference speed within the second tolerance.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings.

Figure 1:
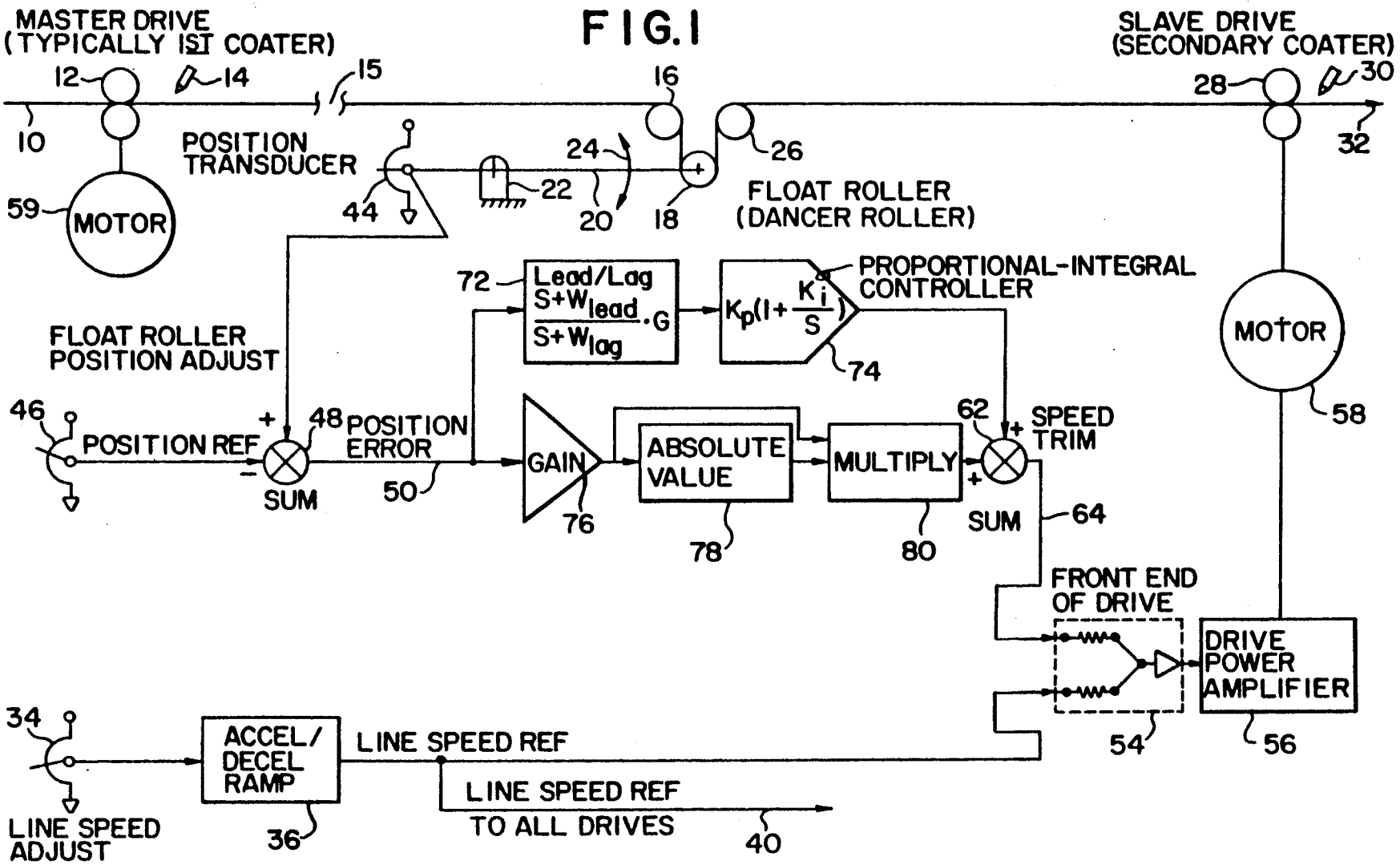
FIG. 1 is a schematic view of a web in a coating machine, along with a schematic diagram of the speed control mechanism utilizing the float roller position to control the gain of the slave drive roller controller (thus the tolerance).

Referring now to FIG. 1, it may be seen that web 10, which is supplied from an upstream supply source (not shown), is conveyed around a first coater roller 12, under a first coater 14, around turning roller 16, float roller 18, turning roller 26, secondary coater roller 28, under second coater 30, and then downstream in the direction of arrow 32 through other sections of the coating machine to be eventually wound up on a takeup reel (not shown).

Web 10 is conveyed as a continuous web; the interruption shown at reference numeral 15 signifies that, between first coater roller 12 and float roller 18, web 10 may travel many hundreds of feet and may be conveyed around perhaps ten drive rollers and multiple operating stations at which operations such as coating take place.

In one preferred embodiment, first coater roller 12 is selected as the master drive roller, although it is believed that any other drive roller could be so selected. It is also preferred that second coater roller 28 be selected as the slave drive roller.

Master drive roller 12 and slave drive roller 28 may be configured otherwise than as shown. For example, a single roller may be used instead of the pair of rollers as shown. Similarly, first and second operating stations, at first and second coaters 14 and 30, respectively, may be positioned further upstream or downstream compared to their illustrated positions; and also they may be oriented on opposite sides of web 10.

Float roller 18 is mounted on arm 20 to pivot about support 22 as indicated by bi-directional arrow 24. Float roller 18 may be oriented otherwise than as shown; for example, it may be positioned above web 10. Also, other types of float rollers may be used.

The speed of slave drive roller 28 is controlled as shown in the simplified diagram in FIG. 1. Line reference speed (SP) is selected or adjusted at line speed adjust element 34 and a signal indicative of the selected line speed is sent to accel/decel ramp block 36. Block 36 determines what acceleration or deceleration value to apply (whether to ramp up or ramp down) and generates a line speed reference signal that is sent to all drives (including the master drive through its drive power amplifier and drive motor 59) as indicated by line 40 and to front end of drive block 54.

Position sensor or transducer 44 (which could be a resolver, LVDT, encoder, rheostat or potentiometer) generates a signal indicative of the position of float roller is, indicative of the amount of web stored at the float roller and sends that signal to summing block 48. In one preferred embodiment, the travel or throw of float roller 18 is about two feet, which yields four feet of web storage. A normal or centered position for float roller 18 is selected or adjusted at float roller position adjust element 46 as a setpoint, which sends a signal to summing block 48. The position signal and the setpoint signal are differenced by summing block 48, which generates a position error signal 50. The position error signal 50 is converted to a speed trim signal 64 through two paths which are summed in summing block 62.

The first path is a conventional controller consisting of lead/lag block 72 and proportional-integral controller block 74. The transfer function in block 72 is given by:

$$\frac{S + \omega_{lead}}{S + \omega_{lag}} \cdot G$$

The gain G in lead-lag block 72 is set to $\omega_{lag}/\omega_{lead}$ in order to provide unity steady-state gain for block 72. The lead-lag compensation provided by block 72 provides normal control compensation, and the values of $\omega_{lead}$ and $\omega_{lag}$ may be determined using common control theory techniques as practiced by a control engineer with normal skill in the art.

The transfer function for block 74 is given by:

$$K_p\left(1 + \frac{K_i}{S}\right)$$

The values of $K_p$ and $K_i$ are selected to give a very low frequency, nearly critically damped fundamental closed-loop response. A typical frequency for the lowest closed loop eigenvalue may be 0.1 radian/second or lower. This selection of gains will result in considerable motion of the float roller in response to incoming speed variations, but will vary the speed of the slave drive roller very slowly.

The second path (blocks 76, 78, and 80) is used because the extremely slow response of the closed-loop control system through the first path (blocks 72 and 74) is inadequate to keep the float roller arm within its travel limits during startup, shutdown, and other speed disturbances (that is, during non-run conditions). In order to keep the float roller arm within its travel limits, a sign-adjusted squared error signal is added to the controller output. Block 76 is an ordinary gain block which simply applies a gain to the position error signal. The absolute value of the gain-adjusted position error signal is taken in block 78. These two signals are multiplied by block 80, resulting in a gain-adjusted squared position error signal which retains the sign of the original position error signal. When the float roller arm position error is close to zero, as it will be during normal operation of the machine, (for example, at times when the coating operations are being performed) the squared position error is even closer to zero, and will have only a very small effect on the speed trim signal 64. When the float roller arm position error is large, the squared float roller arm position error is even larger. This characteristic means that the signal through this second path will have little or no effect when the float roller arm is near setpoint, but will have a large effect when the float roller arm is far from its setpoint, or in other words, near one of its stops. The effect of the second path will be to cause a sufficient slave drive motor speed change to correct a large deviation of the float roller arm from its setpoint. The gain in block 76 is set to accomplish this objective while having little or no effect on the closed loop performance of the control system while the float roller arm is near its setpoint. As a person skilled in the art of control system design, the control engineer will recognize that control stability requirements will provide an upper limit to the gain in block 76.

The speed trim signal developed from summer 62 is then applied to the operational amplifier input section 54 of a motor drive, summed with the line speed reference for the machine as shown and provided to drive power amplifier 56 which drives motor 58.

Figure 2:
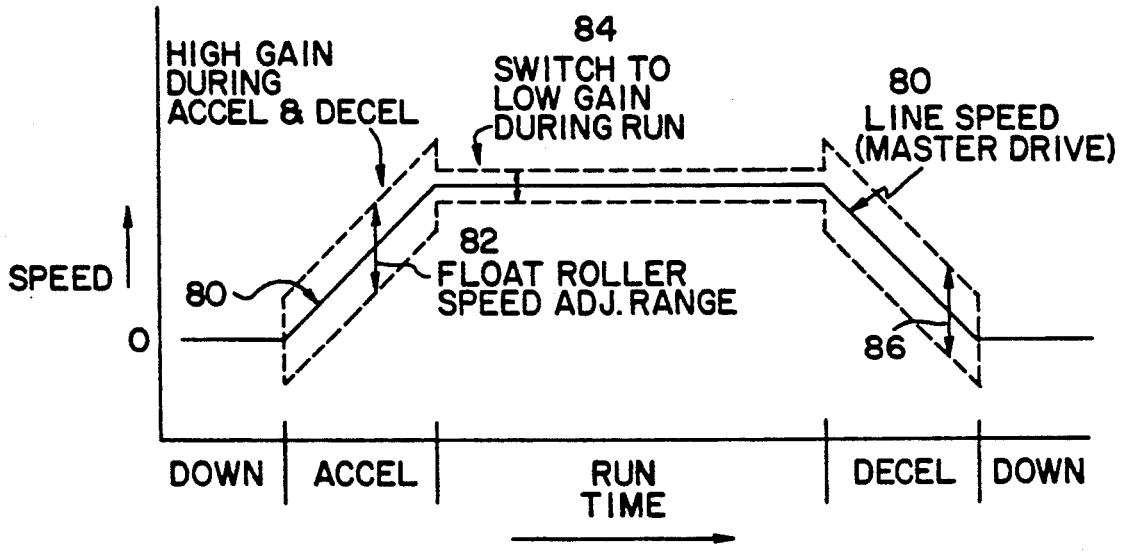
FIG. 2 is a graph illustrating the variation in ranges of tolerance for the slave drive roller where dual range operation is provided.
Figure 3:
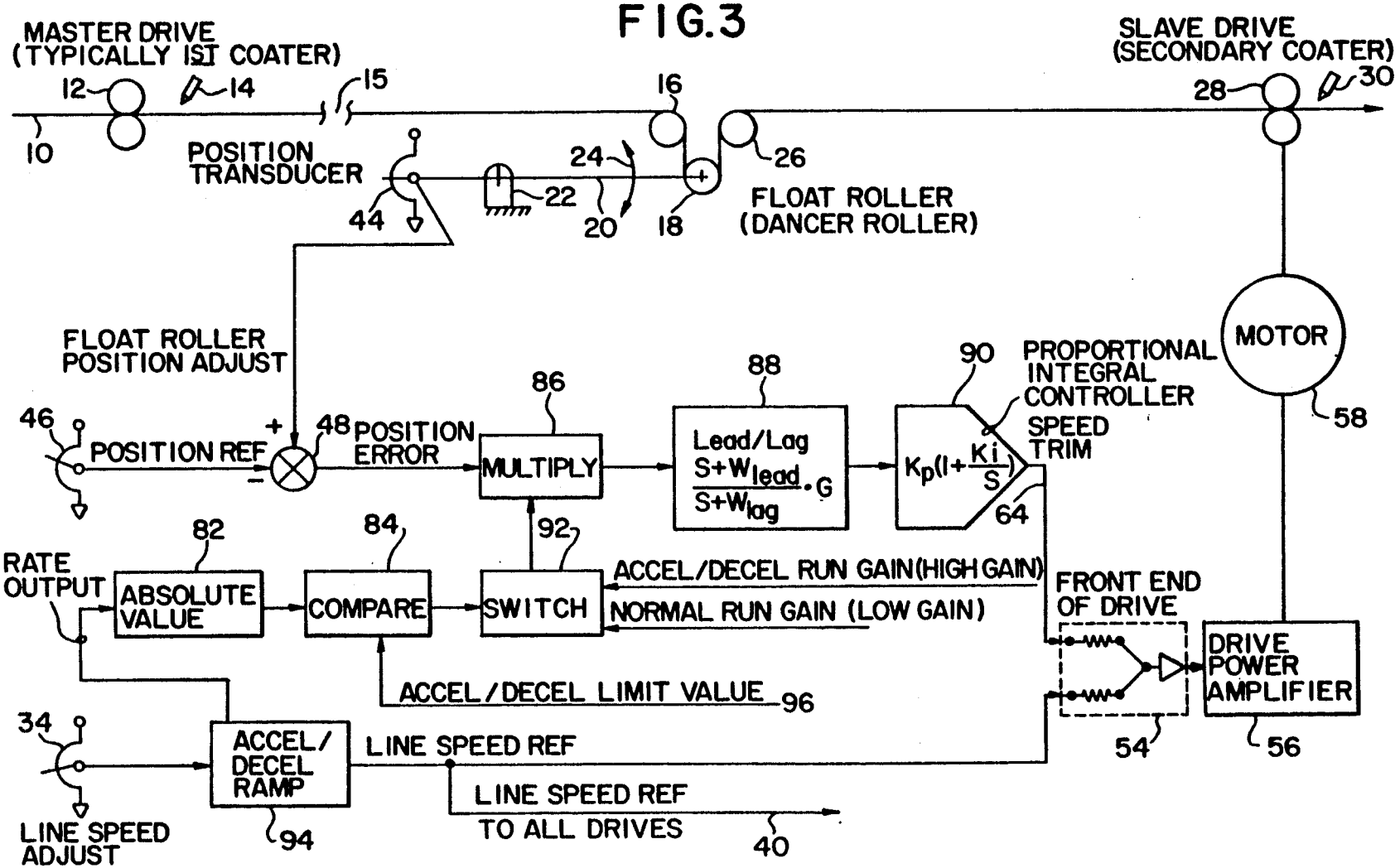
FIG. 3 is a schematic view of a web in a coating machine, along with a schematic diagram of the speed control mechanism utilizing dual range tolerance operations based on the acceleration/deceleration of the master roller.

FIG. 2 illustrates conceptually, an approach where dual tolerance ranges for slave drive roller speed are provided that are switched based on the acceleration or deceleration of the coating machine. The dual tolerance embodiment of the invention is shown in FIG. 3. In FIG. 2, line speed 80 equals the speed of master drive roller 12. At times when the coating machine is down, line speed 80 is zero. At times when the coating machine is accelerating web 10 (ramping up) to operating speed, line speed 80 is increasing. After the coating machine achieves operating or run speed, line speed 80 is substantially constant and coatings are applied to web 10. When coating operations are completed, or when the production line must be stopped for some other reason, line speed 80 is decreasing and the coating machine is decelerating web 10 until the coating machine is down and line speed 80 returns to zero. The line speed typically varies from 100 to 1500 feet per minute (fpm). The speed SP may also have a value in the range of 350 to 700 fpm.

As illustrated by the dashed lines in FIG. 2, the slave drive roller speed tolerance or adjustment range 82,86 is relatively large (e.g. 5%) during times when the coating machine is accelerating from a down condition to a run condition, and when the coating machine is decelerating from a run condition to a down condition, respectively. The line speed is typically changed at an acceleration or deceleration of from 5 to 50 feet/minute/-second. The slave drive roller speed adjustment range 84 (tolerance T2) is relatively small (e.g. 0.05%) during times when the coating machine is in a run condition, for example, when coatings are being applied to web 10. By way of comparison, the tolerance (T1) of the master drive roller (deviation from requested speed to actual speed) is typically 0.025% at all times.

Alternatively, the speed tolerance of the slave drive roller may continuously vary in response to variations in acceleration rather than the dual tolerance approach illustrated above.

FIG. 3 illustrates a second embodiment of the present invention. When the web is accelerating or decelerating, the gain of the slave drive is adjusted to a larger tolerance (e.g., within 5% of the speed of the master drive) to facilitate rapid adjustment of the web to startup or shutdown conditions. When the web is at operational speed (that is, when acceleration is negligible) the tolerance of the slave drive roller is adjusted to a narrower tolerance (e.g., 0.05%). This reduces the response of the control circuitry to positional error.

The elements of FIG. 3 that are the same as the embodiment of FIG. 1 have the same reference number. Float roller position from position transducer 44 is differenced in summing block 48 with the float roll position setpoint from block 46 to generate the position error signal. The position error signal is converted to a speed trim signal 64 by first multiplying the position error by a gain which changes depending upon the operational status of the machine, and then applying a conventional proportional-integral controller with lead/lag.

The gain by which to multiply the position error is selected from one of two choices by switch 92. During normal operation, a low gain value will be selected, and during machine acceleration or deceleration, a higher gain will be selected. The selection input for switch 92 may be determined by any control logic available which is capable of differentiating between when the machine is in normal run mode versus when a speed disturbance is occurring. One example of such logic is shown using blocks 94, 82 and 84. The rate output of ramp block 94 (which is a signal proportional to the rate at which the ramp block output is changing) is converted to an absolute acceleration/deceleration rate by absolute value block 82, which is then compared to an acceleration/deceleration limit. If the absolute ramp rat exceeds the acceleration/deceleration limit value 96, switch 92 selects the acceleration/deceleration gain; otherwise it selects normal run gain.

The rest of the controller is conventional, consisting of lead/lag block 88 and proportional-integral block 90. The gain G in lead-lag block 88 is set to $\omega_{lag}/\omega_{lead}$ in order to provide unity steady-state gain for block 88. Since the primary purpose of this control scheme is to provide the ability to sustain speed variations as small as possible at the slave drive, this control loop will be tuned for very slow, nearly critically damped response when the machine is in normal operating mode (that is, when normal run gain is selected by switch 92). The lead-lag compensation provided by block 88 provides normal control compensation, and the values of $\omega_{lead}$ and $\omega_{lag}$ may be determined using common control theory techniques as practiced by a control engineer with normal skill in the art. The values of $K_p$ and $K_i$ are selected to give a very low frequency, nearly critically damped closed-loop response. A typical frequency for the lowest closed loop eigenvalue may be 0.1 radian/-second or lower. This selection of gains will result in considerable motion of the float roller in response to incoming speed variations, but will vary the speed of the slave drive only very slowly.

When the machine is accelerating or decelerating, the control response must be quicker in order to reliably keep the float roll arm from hitting its stops. This is accomplished by making the acceleration/deceleration gain much larger than the normal run gain. It may be necessary, depending on characteristics of the system such as web material, width, or thickness, the number of rollers, the length of web spans and the type of web conveyance used, to compromise the settings of the adjustments in the lead/lag block 88 and the proportional-integral controller block 90 in order to achieve stability while reliably keeping the float roller arm off its stops.

The speed trim signal 64, developed from block 90 is then applied to the operational amplifier input section of the motor drive, summed with the line speed reference in block 54, amplified in power amplifier block 56 and drives motor 58.

Instead of using discrete components (e.g., op amps) for the block control functions depicted in FIGS. 1 and 3, it is also possible to utilize a commercially available microprocessor-based drive as a controller in a commercially available drive system such as a Reliance DC system to achieve the same results.

It may also be preferable to combine the embodiments of FIG. 1 and FIG. 3 so that a control system is provided that responds to acceleration as in FIG. 3 as well as to positional error as in FIG. 1.

It will be apparent to those skilled in the art that various modifications and variations may be made to the method and apparatus of the invention without departing from the scope of the invention. It is, therefore, to be understood that, within the scope of the appended claims, the invention may be practiced otherwise than as specifically described.

What is claimed is:

1. A method for controlling the speed of a slave drive roller, comprising the steps of:

conveying a web around a master drive roller, a float roller, and a slave drive roller;

performing at least one operation on the web at selected times;

providing a reference speed signal indicative of a reference speed SP;

driving the master drive roller at speed SP;

driving the slave drive roller at speed SP within a first tolerance at times when the at least one operation is being performed; and at times when the at least one operation is not being performed, changing the reference speed, driving the master drive roller at the changed reference speed, changing the tolerance of the speed of the slave drive roller beyond the value of the first tolerance, and driving the slave drive roller at the changed reference speed within the changed tolerance, wherein the step of driving the slave drive roller includes the steps of, sensing a position of the float roller indicative of an amount of the web stored at the float roller; and changing the speed of the slave drive roller, based on the sensed position of the float roller, to maintain the amount of web at the float roller within a limit, wherein the step of changing the speed of the slave drive roller includes changing the speed of the slave drive roller according to a power, greater than one, of a sensed deviation from a set position of the float roller.

2. The method of claim 1, wherein the web conveying step includes conveying a web having a substrate for photosensitive film or paper.

3. The method f claim 2, wherein the at least one operation includes a coating operation.

4. The method of claim wherein the first tolerance is plus or minus 0.05% at times when the at least one operation is being performed.

5. The method of claim 4, wherein the changed tolerance is a constant plus or minus 5% at times when the at least one operation is not being performed.

6. The method of claim 1, wherein speed SP has a value in the range of 100 to 1500 fpm.

7. The method of claim 6, wherein speed SP has a value in the range of 350 to 700 fpm.

8. The method of claim 1, including the steps of:

sensing a rate of change of the reference speed; and changing the speed of the slave drive roller based on the sensed rate of change of the reference speed to maintain an amount of web at the float roller within a limit.

9. The method of claim 8, wherein the step of changing the reference speed includes changing the reference speed at an acceleration or deceleration of from 5 to 50 feet/minute/second.

10. The method of claim 1 wherein a throw of the float roller is about two feet.

11. A method for controlling the speed of a slave drive roller, comprising the steps of:

conveying a web around a master drive roller, a float roller, and a slave drive roller;

performing at least one operation on the web at selected times;

providing a reference speed signal indicative of a reference line speed SP;

driving the master drive roller at speed SP;

determining a position error of the float roller indicating a displacement of the float roller from a normal position;

adjusting the speed of the slave drive roller according to the position error modified according to whether the at least one operation is being performed, wherein a determination of whether the at least one operation is taking place is determined by a magnitude of the position error; and wherein the adjusting step includes adjusting the speed of the slave drive roller according to first and second adjusted position error signals and the reference speed, the position error being adjusted by a first factor to produce the first adjusted position error signal and a second factor to produce the second adjusted position error signal, the second factor multiplying the position error modified by a gain, by a power greater than one.

12. The method of claim 11 wherein a throw of the float roller is about two feet.

13. A method for controlling the speed of a slave drive roller, comprising the steps of:

conveying a web around a master drive roller, a float roller, and a slave drive roller;

performing at least one operation on the web at selected times;

providing a reference speed signal indicative of a reference line speed SP;

driving the master drive roller at speed SP;

determining a position error of the float roller indicating a displacement of the float roller from a normal position;

sensing a rate of change of the reference speed and generating an acceleration signal indicating the rate of change; and adjusting the speed of the slave drive roller according to the position error modified by a gain, the gain being determined according to the acceleration signal.

14. The method of claim 13 wherein the speed of the slave drive roller is adjusted according to the position error multiplied by the gain, the gain being a first gain when the acceleration signal indicates a first range of acceleration, and a second gain when the acceleration signal indicates a second range of acceleration.

* * * * *